United States Patent [19]

Sato

[11] Patent Number: 4,689,439

[45] Date of Patent: Aug. 25, 1987

[54] SUPERCONDUCTING-COIL APPARATUS

[75] Inventor: Akio Sato, Yokohama, Japan

[73] Assignee: Kabushiki Kasiha Toshiba, Kawasaki, Japan

[21] Appl. No.: 911,439

[22] Filed: Sep. 25, 1986

[30] Foreign Application Priority Data

Sep. 30, 1985 [JP] Japan ..... 60-216423

[51] Int. Cl.[4] ..... H01F 7/22; F25B 19/00

[52] U.S. Cl. ..... 174/15 CA; 62/113; 62/502; 62/514 R; 174/11 R; 174/18; 335/216

[58] Field of Search ..... 174/9 R, 11 R, 12 R, 174/15 R, 15 CA, 17 VA, 18; 335/216; 62/55.5, 113, 259.2, 502, 514 R, 514 JT

[56] References Cited

U.S. PATENT DOCUMENTS 3,992,893 11/1976 Claudet et al. ..... 62/502 X

*Primary Examiner*—Laramie E. Askin

*Attorney, Agent, or Firm*—Oblon, Fisher, Spivak, McClelland & Maier

[57] ABSTRACT

A superconducting-coil apparatus according to the present invention comprises a normal-fluid helium bath, a superfluid helium bath, a channel connecting the two baths, superconducting coils contained in the superfluid helium bath, current lead wires extending from an exciting current source to the superconducting coils, through the channel, and a valve plug normally closing the channel and adapted to open the channel when the pressure inside the superfluid helium bath rises above a predetermined level. If the superconducting coils undergo quenching while they are being excited, the superfluid helium is gasified by Joule heat, produced in the coils. As a result, the pressure inside the superfluid helium bath increases, so that the valve plug is urged to open the channel due to the pressure difference. The gasified helium directly cools those portions of the lead wires which pass through the channel, thus these wire portions are prevented from being burned out.

11 Claims, 6 Drawing Figures

SUPERCONDUCTING-COIL APPARATUS

BACKGROUND OF THE INVENTION

The present invention relates to a superconducting-coil apparatus in which a superconducting coil unit is cooled by superfluid helium, and more specifically, to a superconducting-coil apparatus in which current lead wires, connected between an exciting current source and a superconducting coil unit, are cooled to avoid burning, in the event of quenching.

In superconducting-coil apparatuses of this type, when liquid helium is cooled to a normal-fluid state, a superconducting coil is changed from normal-conducting state to superconducting state. When liquid helium is further cooled to change from normal-fluid state to superfluid state ($\lambda=2.17$ K), the superconducting coil is changed from superconducting state to highly stable superconducting state. If the coils are excited in the superconducting state, they produce a high-intensity magnetic field, without any substantial electrical loss.

One such prior art superconducting-coil apparatus is disclosed in U.S. Pat. No. 3,992,893. This apparatus is provided with a cryostat, which includes a superfluid helium bath and a normal-fluid helium bath. A liquid helium contained in the superfluid helium bath is maintained in the superfluid state and a liquid helium contained in the normal-fluid helium bath is maintained in the normal-fluid state. The normal-fluid bath and superfluid bath are thermally insulated by an insulator and coupled to each other through a channel and a superconducting coil unit is immersed in the superfluid helium.

In a conventional superconducting-coil apparatus disclosed in a document, lead wires for supplying a current to the superconducting coil unit are extended from the exciting current source to the superconducting coil through the normal fluid bath, the channel and the superfluid bath so that the lead wires are maintained at a sufficiently low temperature. Furthermore, an insulating member is detachably fitted in the channel to prevent heat from being transferred between the baths through the channel.

The superconducting coil unit may sometimes undergo quenching while it is being excited. The quenching is a phenomenon where the coil unit changes from superconducting state to normal-conducting state. If such quenching occurs, a large amount of electrical energy, stored in the coil unit, might possibly break the coil unit. In the event of quenching, therefore, the current supply to the coil unit is cut off, so that the excitation of the coil unit is interrupted. At the same time, the current lead wires extending from the coil unit are shorted by an electric resistor, which is connected between the lead wires. As a result, the electrical energy in the coil unit is dissipated.

In the normal-conducting state, however, the superconducting coil unit has an electric resistance. Therefore, part of the electrical energy is converted into Joule heat, in the coil unit, so that the coil unit is heated. The Joule heat, delivered from the heated coils, is transmitted through the current lead wires. When the heat reaches those portions of the lead wires inside the channel, it is stored in the channel, in which the insulator is inserted. As a result, these wire portions may possibly be burned out, without being cooled substantially.

SUMMARY OF THE INVENTION

The object of the present invention is to provide a superconducting-coil apparatus in which those portions of current lead wires passing through a channel can be prevented from being burned out if the superconducting coil unit undergoes quenching.

According to a superconducting-coil apparatus of the present invention, a cryostat comprises a superfluid helium bath and a normal-fluid helium bath, which communicate with each other by means of a channel. The superfluid helium bath contains a liquid helium which is cooled to the superfluid state, while the normal-fluid helium bath contains a liquid helium which is cooled to the normal-fluid state. A superconducting coil unit is contained in the superfluid helium bath. A pair of current lead wires are connected between an exciting current source and the coils and extended from the normal-fluid helium bath to the superfluid helium bath through the channel. A valve plug is provided so as to close the channel and to insulate the superfluid helium bath from the normal-fluid helium bath. It is adapted to open the channel when the pressure inside the superfluid helium bath rises above a predetermined level. If the superconducting coil unit undergoes quenching while it is being excited, the superfluid helium is gasified by Joule heat, produced in the coil unit. As a result, the pressure inside the superfluid helium bath increases, so that the valve plug is urged to open the channel due to the pressure difference. The gasified helium directly cools those portions of the lead wires which pass through the channel, thus preventing these wire portions from being burned out.

DETAILED DESCRIPTION OF THE PREFERRED EMBODIMENTS

Figure 1:
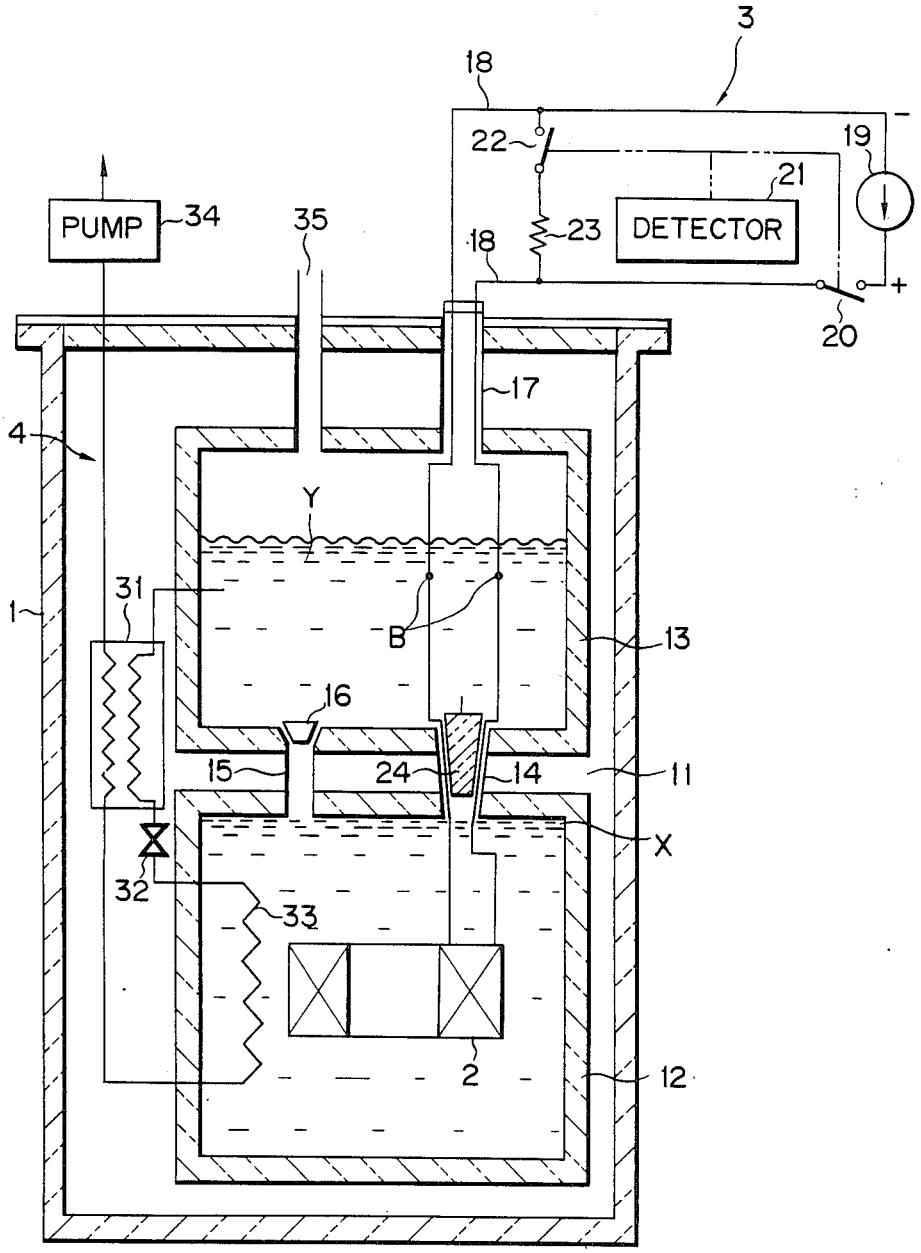
FIG. 1 is a schematic view showing an arrangement of a superconducting-coil apparatus according to the present invention.

As shown in FIG. 1, a superconducting-coil apparatus according to an embodiment of the present invention comprises cryostat 1, which includes superfluid helium bath 12 and normal-fluid helium bath 13. Superconducting coil unit 2 is contained in bath 12. Exciting current-supply circuit 3 is provided for exciting the coils, and cooling means 4 is used to produce superfluid helium.

In cryostat 1, normal-fluid helium bath 13 overlies superfluid helium bath 12. Baths 12 and 13 contain liquid heliums X and Y, respectively, which are in the normal-fluid state (at 4.2 K). Helium X in bath 12 is cooled from normal-fluid state to superfluid state, by cooling means 4. Vacuum insulator 11 is disposed so as to cover both helium baths 12 and 13. Channel 14 is formed so as to penetrate insulator 11, and connects baths 12 and 13. The function of channel 14 will be described in detail later. Communication channel 15 is formed so as to penetrate insulator 11, and connects baths 12 and 13. The liquid helium is fed from bath 13 into bath 12, through communication channel 15. Communication channel 15 is regulated by valve 16. Liquid helium conduit 35 extends through the upper portion of bath 13. The liquid helium is introduced from the outside of cryostat 1 into bath 13, through conduit 35.

Superconducting coil unit 2 is formed of a core (not shown) and a superconducting wire (not shown) which is wound on the core for a multitude of turns. The superconducting wire is composed of a superconducting filament and a stabilizer which confines the superconducting filament. The electric resistance of the superconducting filament is substantially zero when the filament is in the superconducting state, while it will be very high when the filament is in normal-conducting state. The stabilizer is formed of a material having a good thermal conductance, such as copper wire. Coils 2 are fixed in superfluid helium bath 12, by means of a supporting member (not shown), so as to be immersed in liquid helium X.

A pair of current lead wires 18 extend individually from two end portions of the superconducting wire of superconducting coil unit 2. The lead wires are extended to exciting current-supply circuit 3, through channel 14, normal-fluid helium bath 13, and conduit 17 attached to the top portion of bath 13. Each wire 18 is formed of a superconducting-wire portion and a copper-wire portion, so that its production of Joule's heat is suppressed. The superconducting-wire portion extends between coil unit 2 and each corresponding point B, as shown in FIG. 1. The copper-wire portion extends between exciting current source 19 and point B.

In exciting current-supply circuit 3, current source 19 and switch 20 are connected in series with current lead wires 18. Switch 22 and electric resistor 23 are connected in parallel with source 19 and switch 20, thus serving as protecting means in the event of quenching, which will be mentioned later. Quenching detector 21 is provided for detecting quenching of superconducting coil unit 2, and delivering switching signals to switches 20 and 22. In response to the switching signals, switch 20 is turned off, so that the supply of exciting current to coil unit 2 is interrupted. On the other hand, switch 22 is turned on, so that a closed circuit, including coils 2, lead wires 18, and resistor 23, is formed.

In cooling means 4, liquid helium Y in normal-fluid helium bath 13 is expanded adiabatically and cooled to a temperature lower than the superfluid temperature (2.17 K). Helium Y takes heat away from liquid helium X in superfluid helium bath 12, thereby changing helium X into superfluid helium. To this end, the primary side of Joule-Thomson first heat exchanger 31 is connected to bath 13. Joule-Thomson throttle valve 32 is connected to the lower-course end of the primary side of exchanger 31, whereby helium Y is expanded adiabatically. Second heat exchanger 33 is connected on the lower-course side of valve 32, whereby heat is exchanged between cooled liquid helium Y and helium X in bath 12. Vacuum pump 34 is connected to the lower-course side of exchanger 33, through the secondary side of exchanger 31.

Figure 2:
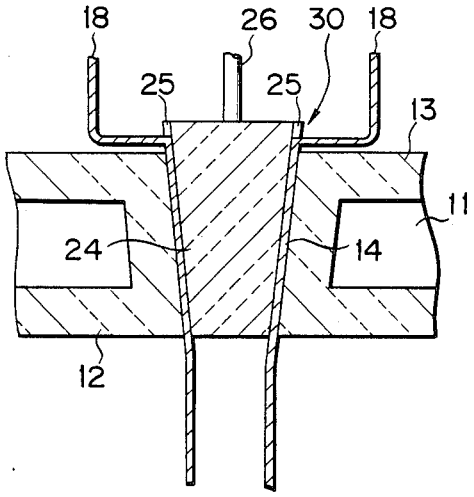
FIG. 2 is a sectional view of a channel of the apparatus shown in FIG. 1.
Figure 3:
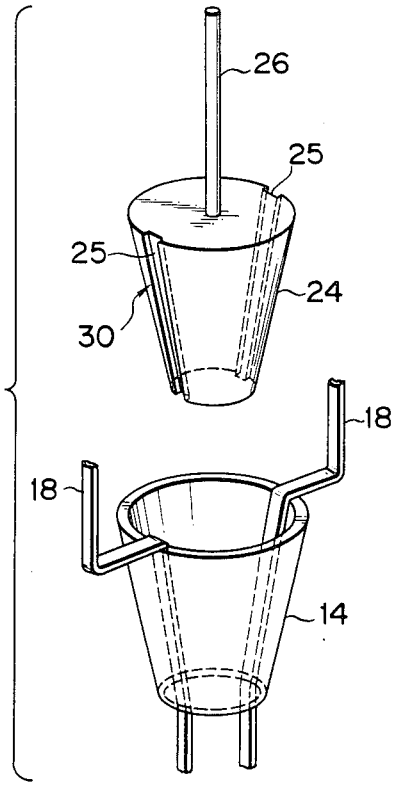
FIG. 3 is an exploded perspective view of the channel of the apparatus shown in FIG. 1.

As shown in FIGS. 2 and 3, channel 14, in the form of a truncated cone, has a larger diameter on the side of normal-fluid helium bath 13, and a smaller diameter on the side of superfluid helium bath 12. An opening portion of channel 14 serves also as a valve seat for valve plug 24. The valve plug is made of an insulator which is shaped like a truncated cone, corresponding to channel 14. Plug 24 is fitted closely into channel 14, from the side of bath 13. When the pressure inside bath 12 rises above a predetermined level, valve plug 24 moves upward due to the pressure difference between the pressure inside bath 12 and the pressure inside bath 13, thus opening channel 14.

Channel 14 has a fitting surface which is closely fitted on the outer peripheral surface of valve plug 24 when the valve plug is inserted into the channel, and current lead wires 18 extend between the outer peripheral surface of plug 24 and the fitting surface of channel 14. Spaces or lead wire holding portions 30 are secured between the outer peripheral surface of plug 24 and the fitting surface of channel 14, for the protection of wires 18. As shown in FIG. 3, for example, portions 30 may be grooves 25 on the outer peripheral surface of plug 24, in which wires 18 are fitted. Rod 26 projects from the top face of valve plug 24, on the larger-diameter side thereof. The rod serves to facilitate insertion of plug 24 into channel 14. An elastic member (not shown) is disposed in normal-fluid helium bath 13, whereby plug 24 is urged to be pressed against channel 14.

The operation of the superconducting-coil apparatus, according to the aforementioned embodiment, will be described.

In order to change liquid helium X in superfluid helium bath 12 into superfluid helium, cooling means 4 operates as follows. When vacuum pump 34 is actuated, liquid helium Y in normal-fluid helium bath 13, at the normal-fluid temperature (4.20 K), flows through the primary side of Joule-Thomson first heat exchanger 31, Joule-Thomson throttle valve 32, second heat exchanger 33, and the secondary side of first exchanger 31. After flowing out of bath 13, helium Y is precooled by exchanger 31. Thereafter, it is expanded as it passes through valve 32. As a result, the pressure of helium Y lowers, and its temperature drops below the superfluid temperature (2.17 K). In second exchanger 33, helium Y is evaporated, thereby taking heat away from helium X in bath 12. Thus, helium X is changed into superfluid helium.

After liquid helium X in superfluid helium bath 12 has changed into superfluid helium, superconducting coil unit 2 is excited. When switch 20 is turned on, current is supplied from exciting current source 19 to coil unit 2, through current lead wires 18. If the current flowing through coil unit 2 is increased, at a fixed rate, to a predetermined level, a large amount of electrical energy is stored in coil unit 2, and a high-intensity magnetic field is produced by the coil unit.

While being excited, superconducting coil unit 2 may sometimes undergo quenching. Quenching detector 21 detects such quenching, and supplies detection signals to switches 20 and 22. In response to the detection signals, switch 20 is turned off, so that the exciting current supply to coil unit 2 is interrupted. At the same time, switch 22 is turned on, so that a closed circuit, including coil unit 2, current lead wires 18, and electric resistor 23, is formed. Most of the electrical energy, stored in coil unit 2, is consumed by resistor 23.

If quenching occurs in superconducting coil unit 2, the superconducting filament portion of the superconducting wire, constituting coil unit 2, changes from superconducting state to normal-conducting state. As a result, a large electric resistance is produced in the superconducting filament portion. The current flows through the stabilizer, so that the electrical energy in coil unit 2 is converted into Joule heat. By this Joule heat, part of liquid helium X around coil unit 2 is gasified. Accordingly, the pressure inside superfluid helium bath 12 increases rapidly. When the pressure reaches a predetermined level, valve plug 24 is pushed up into normal-fluid helium bath 13 due to the pressure difference between the pressure inside bath 12 and the pressure inside bath 13. At the same time, the gasified helium is jetted into bath 13 through channel 14.

The Joule heat, produced in superconducting coil unit 2, is transmitted to those portions of current lead wires 18 located inside channel 14. Since valve plug 24 is removed from channel 14, however, the heat cannot be stored in channel 14. Moreover, the inside channel 14 is cooled fully by the gasified helium, passing through the channel. Also, those portions of wires 18 inside channel 14 are touched and cooled fully by the gasified helium and the liquid helium. Thus, these wire portions can be prevented from being burned by the Joule heat, in the event of quenching.

The arrangement of channel 14, according to the present invention, is not limited to the embodiment described above, and may be modified variously as follows.

Figure 4:
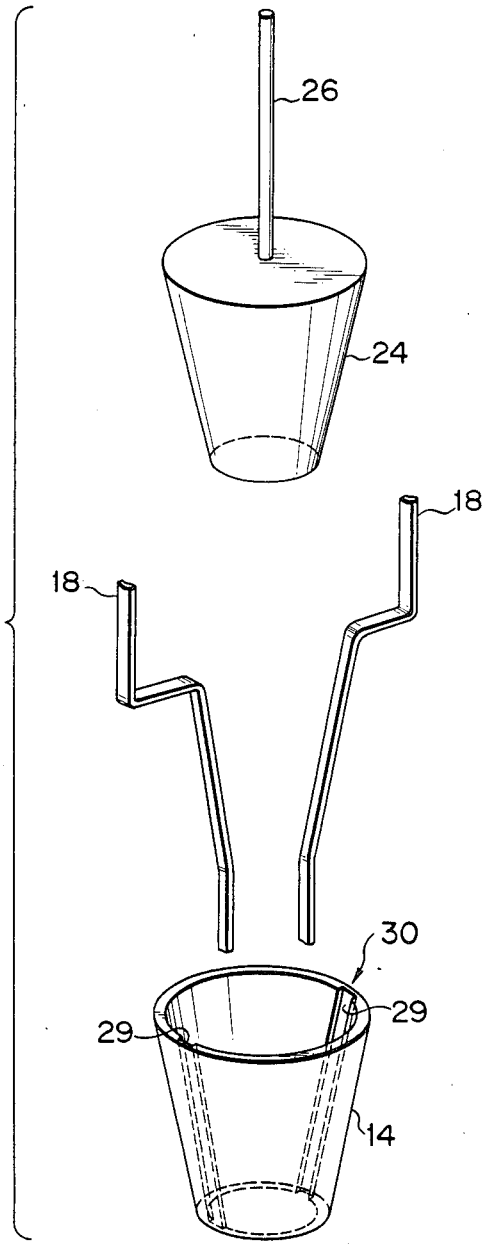
FIGS. 4, 5 and 6 are exploded perspective views showing modifications of the channel of the superconducting-coil apparatus of FIG. 1.

As shown in FIG. 4, lead wire holding portions 30, for securing spaces between the fitting surface of channel 14 and the outer peripheral surface of valve plug 24, may be grooves 29 which are formed on the fitting surface of channel 14, so that current lead wires 18 are fitted individually in the grooves.

Figure 5:
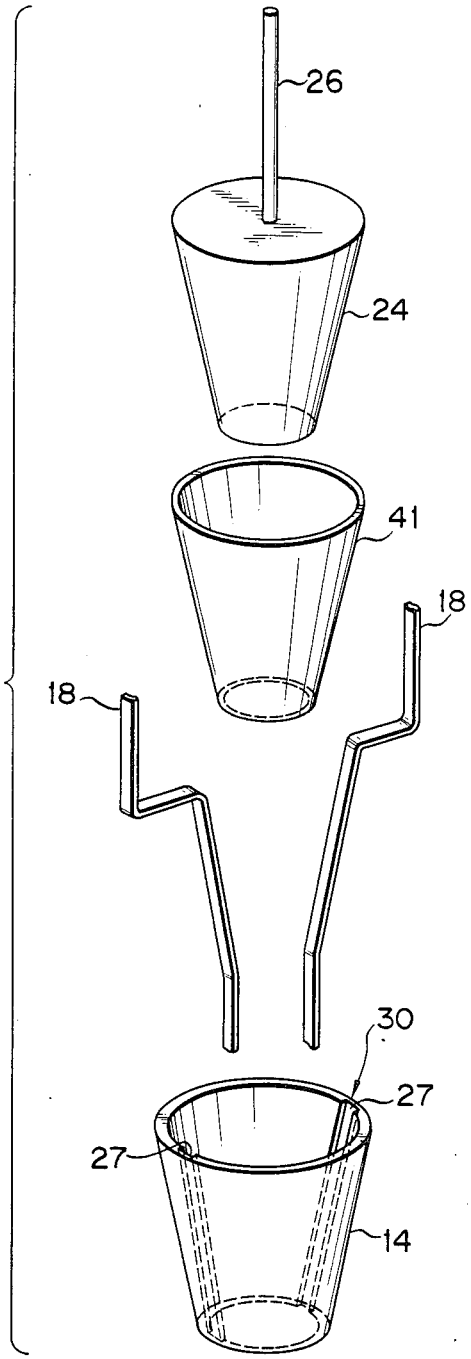

In a modification shown in FIG. 5, holding portions 30 are grooves 27 which are formed on the fitting surface of channel 14, so that lead wires 18 can be fitted individually in the grooves. In this case, thin-walled pipe 41, in the form of a truncated cone, is disposed between the outer peripheral surface of valve plug 24 and the fitting surface of channel 14. If pipe 41 is made of material of low thermal conductivity, heat is prevented from being transferred between the baths. Pipe 41 is formed of thin-wall, so that it serves to accelerate cooling of wires 18 by liquid helium X, in the event of quenching. A filler, such as silicone grease, is interposed between the fitting surface of channel 14 and the outer peripheral surface of pipe 41.

Figure 6:
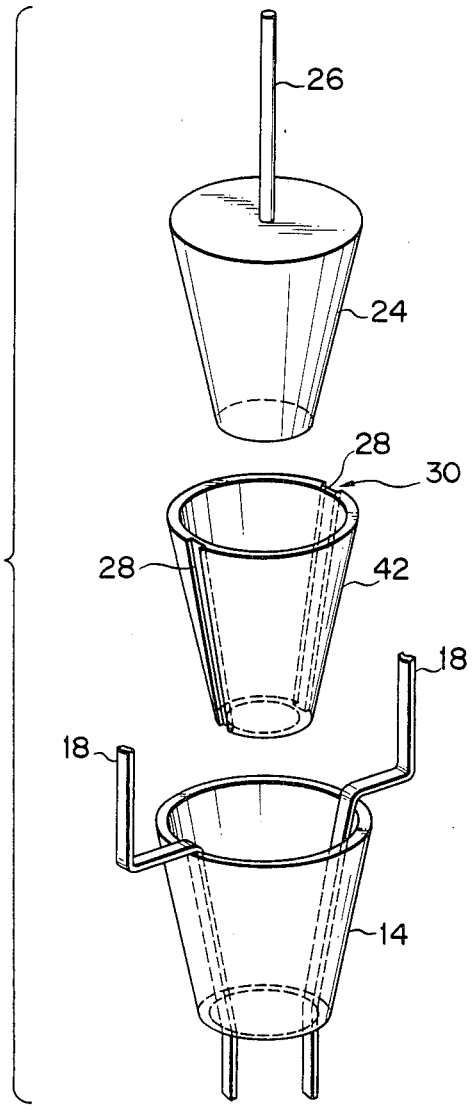

As shown in FIG. 6, moreover, lead wire holding portions 30 may be grooves 28 which are formed on the outer peripheral surface of thin-walled pipe 42, so that lead wires 18 can be fitted individually in the grooves. When changing the width of wires 18, according to this modification, only pipe 42 must be replaced. Thus, the replacement cost is low.

What is claimed is:

1. A superconducting-coil apparatus comprising:

a cryostat including a superfluid helium bath containing a liquid helium in the superfluid helium state, a normal-fluid helium bath containing a liquid helium in the normal-fluid helium state, an insulator for thermally insulating the normal-fluid helium bath from the superfluid helium bath, and a channel penetrating the insulator and connecting the normal-fluid helium bath and the superfluid helium bath;

superconducting coil unit contained in the superfluid helium bath, and immersed in the liquid helium, in the superfluid helium bath;

exciting current source means for exciting said superconducting coil unit;

a pair of current lead wires extending from said exciting current source means to said superconducting coil unit, through normal-fluid helium bath, the channel, and superfluid helium bath; and a valve plug normally closing the channel to insulate the normal-fluid helium bath from the superfluid helium bath and urged to open the channel due to the pressure difference, which occurs when the pressure inside the superfluid helium bath rises above a predetermined level, to connect the superfluid helium bath with the normal-fluid helium bath.

2. The superconducting-coil apparatus according to claim 1, wherein said valve plug is formed of an insulator.

3. The superconducting-coil apparatus according to claim 1, wherein said valve plug has a tapered section and the channel is formed into a tapered shape and has a first opening in the normal-fluid helium bath, the tapered section of said valve plug being inserted into the channel through the first opening and closely fitted in the channel.

4. The superconducting-coil apparatus according to claim 3, wherein said valve plug has an outer peripheral surface and the channel has a fitting surface which is closely fitted on the outer peripheral surface of said valve plug when said valve plug is inserted into the channel, and lead wire holding portions are provided between the fitting surface of the channel and outer peripheral surface of said valve plug, whereby spaces for the current lead wires are secured between the fitting surface of the channel and the outer surface of the valve plug.

5. The superconducting-coil apparatus according to claim 4, wherein said lead wire holding portions include grooves, formed on the outer peripheral surface of the valve plug, so that said current lead wires are fitted in the grooves.

6. The superconducting-coil apparatus according to claim 4, wherein said lead wire holding portions include grooves, formed on the fitting surface of the channel, so that said current lead wires are fitted in the grooves.

7. The superconducting-coil apparatus according to claim 4, wherein a pipe is disposed between the outer peripheral surface of said valve plug and the fitting surface of the channel, and said lead wire holding portions include grooves, formed on the fitting surface of the channel, so that said current lead wires are fitted in the grooves.

8. The superconducting-coil apparatus according to claim 4, wherein a pipe having an outer peripheral surface is disposed between the outer peripheral surface of said valve plug and the fitting surface of the channel, and said lead wire holding portions include grooves, formed on the outer peripheral surface of the pipe, so that said current lead wires are fitted in the grooves.

9. The superconducting-coil apparatus according to claim 1, wherein at least those portions of said pair of current lead wires passing through the superfluid helium bath and the channel are composed of superconducting wires.

10. The superconducting-coil apparatus according to claim 1, further comprising cooling means for cooling the liquid helium, contained in the superfluid helium bath.

11. The superconducting-coil apparatus according to claim 10, wherein said cooling means includes a first heat exchanger for precooling the liquid helium in the normal-fluid helium bath; a throttle valve connected to the lower-course side of the first heat exchanger, for adiabatically expanding the cooled liquid helium, thereby lowering the temperature of the liquid helium below the superfluid temperature; a second heat exchanger connected to the lower-course side of the throttle valve, for effecting a heat exchange between the liquid helium below the superfluid temperature and the liquid helium in the superfluid helium bath; and a pump connected to the lower-course side of the second heat exchanger, through the secondary side of first heat exchanger.

* * * * *

UNITED STATES PATENT AND TRADEMARK OFFICE

CERTIFICATE OF CORRECTION

PATENT NO. : 4,689,439

DATED : August 25, 1987

INVENTOR(S) : Akio Sato

It is certified that error appears in the above-identified patent and that said Letters Patent is hereby corrected as shown below:

On the title page assignee should read

--(73)Assignee: Kabushiki Kaisha Toshiba --.

Signed and Sealed this

Twenty-ninth Day of March, 1988

*Attest:*

DONALD J. QUIGG

*Attesting Officer*

*Commissioner of Patents and Trademarks*